United States Patent [19]

Johnston et al.

[11] Patent Number: 4,643,469

[45] Date of Patent: Feb. 17, 1987

[54] GATE LATCH

[75] Inventors: James R. Johnston, Sterling; Marlin D. Crown, Sycamore, both of Ill.

[73] Assignee: National Manufacturing Co., Sterling, Ill.

[21] Appl. No.: 771,797

[22] Filed: Sep. 3, 1985

Related U.S. Application Data

[63] Continuation of Ser. No. 518,760, Jul. 29, 1983, abandoned.

[51] Int. Cl.[4] ..... E05C 5/00

[52] U.S. Cl. ..... 292/66; 292/67; 292/148; 292/236; 292/DIG. 13

[58] Field of Search ..... 292/57, 58, 63, 66, 292/67, 148, 205, 236, DIG. 13

[56] References Cited

U.S. PATENT DOCUMENTS

| | | | |
|---|---|---|---|
| 1,326,554 | 12/1919 | Watson . | |
| 1,693,158 | 11/1928 | Reinicke et al. | 292/58 X |
| 1,728,747 | 9/1929 | Chesher | 292/67 X |
| 1,868,471 | 7/1932 | Griffin . | |
| 2,631,877 | 3/1953 | Ainsworth . | |
| 2,794,663 | 6/1957 | Grodt et al. . | |
| 4,062,575 | 12/1977 | Robins . | |

FOREIGN PATENT DOCUMENTS

| | | | |
|---|---|---|---|
| 194511 | 3/1923 | United Kingdom | 292/236 |
| 236014 | 7/1925 | United Kingdom | 292/236 |

*Primary Examiner*—Robert L. Wolfe
*Assistant Examiner*—Lloyd A. Gall
*Attorney, Agent, or Firm*—Edmond T. Patnaude

[57] ABSTRACT

A latch for use with a gate includes a latch body having a planar mounting surface on a rearward side thereof with a pair of space apart flanges which receive a bolt in openings thereto. The bolt is positioned parallel to the surface of the gauge and is slidably and rotatably disposed within the flange openings. An enlargement on one side of the bolt will allow the bolt to pass through one of the flanges when in a predetermined angular position for removal. However an offturned end of the bolt extends rearwardly of the mounting surface, and the bolt enlargement is so oriented such that the bolt is not removable from the latch body when the body is normally attached to the gate.

11 Claims, 8 Drawing Figures

GATE LATCH

This is a continuation of application Ser. No. 518,760, filed July 29, 1983, now abandoned.

The present invention relates in general to latches of the type commonly used on gates and which can be actuated from both sides of the associated gates, and it relates in particular to a new and improved gate latch which may be easily assembled in the field and requires no rivits or other fasteners for holding the latch parts in mutually assembled relationship.

BACKGROUND OF THE INVENTION

Gate latches generally include a number of parts which are assembled at a factory and packaged in assembled form. The repair of such latches is difficult, and moreover, the parts thereof are sometimes fragile and easily damaged.

It would be desirable to provide a gate latch which is rugged and durable in construction. Preferably the parts should not be easily damaged, and the latch should be constructed so as to permit it to be assembled in the field and, if necessary, disassembled without any special tools.

SUMMARY OF THE INVENTION

Briefly, there is provided in accordance with the present invention a new and improved locable gate latch which employs a cylindrical latch bolt which is pivotable between latching and unlatching positions and which is axially slidable between locked and an unlocked position. Means are provided on the bolt for preventing removal of the latch bolt from the latch when the latch is mounted to a gate or door, which bolt itself prevents removal of a manually operated latch operating lift bar from the latch. Also, means are provided to padlock the bolt in the locked position.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 1:
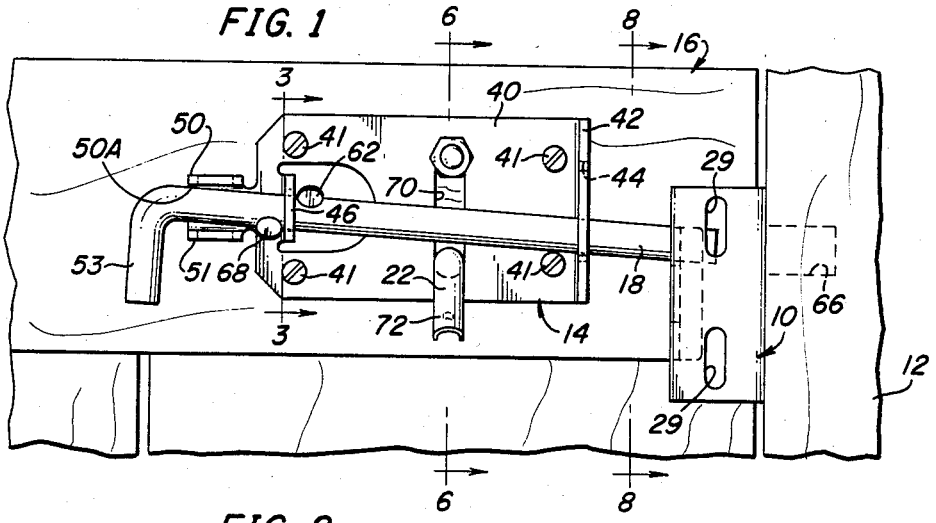
FIG. 1 is an elevational view of a gate latch embodying the present invention, which latch is mounted to a gate and shown in an unlocked, latched position.
Figure 5:
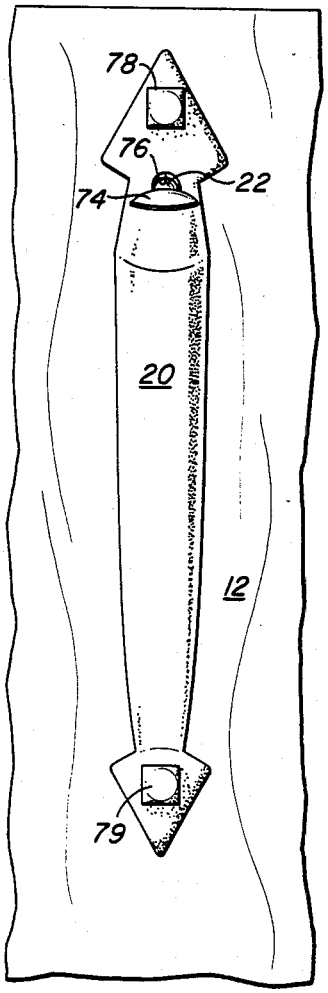
FIG. 5 is an elevational view of the latch of FIG. 1, but taken from the opposite side of the gate.
Figure 6:
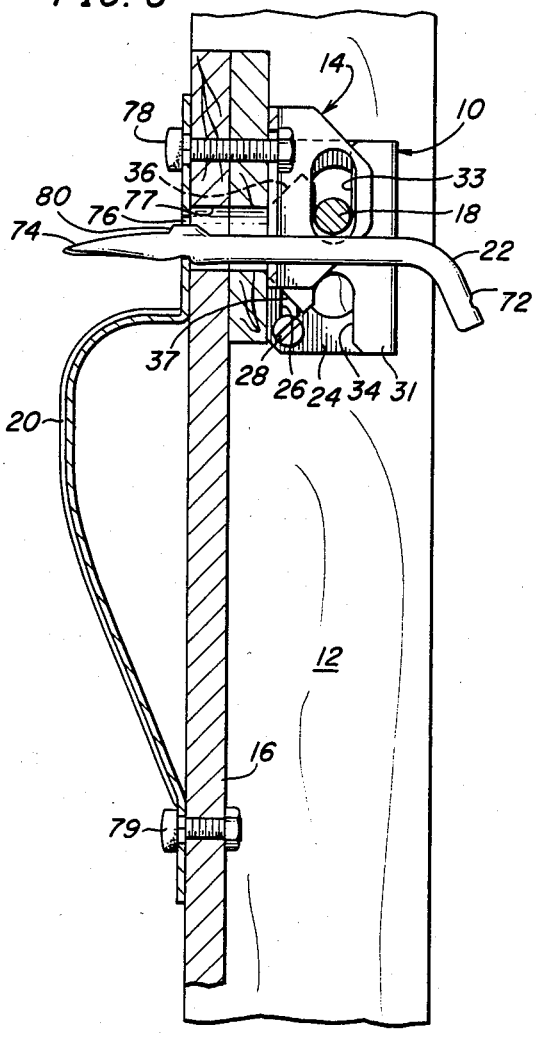
FIG. 6 is a cross-sectional view taken along the line 6—6 of FIG. 1.

Referring particularly to FIGS. 1, 5 and 6, the principal elements of a gate latch may be seen to include strike 10 mounted to a gate post 12; a latch body 14 mounted to one face of a gate 16; a generally cylindrical bolt 18 slidably and pivotably mounted to the latch body 14; a handle 20 mounted to the opposite face of the gate 16; and a bolt lifter in the form of a thumb lever 22 which extends through alligned openings in the latch body 14, the gate 16 and the handle 20.

Figure 7:
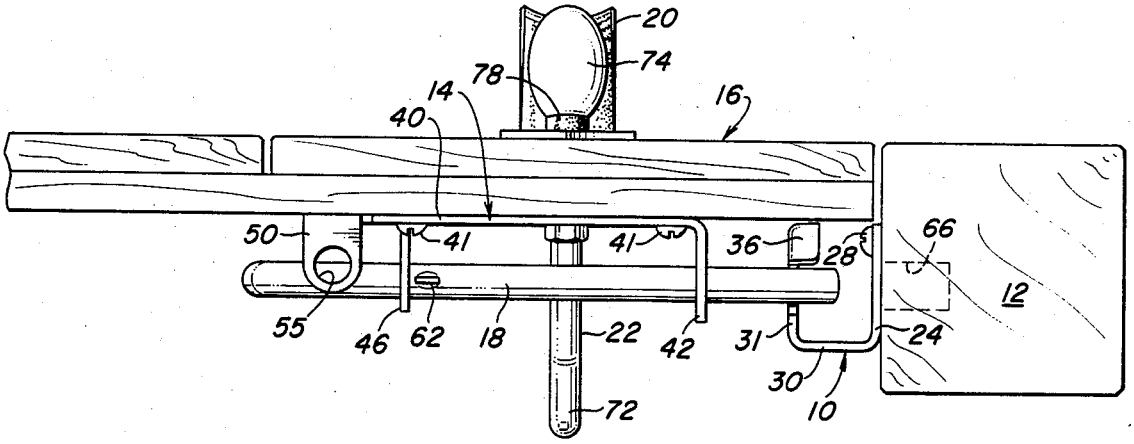
FIG. 7 is a top view looking down on the latch and gate of FIG. 1.

The strike 10 is symmetrical about its central horizontal plane for use with left-hand or right hand swinging gates and includes a base 24 provided with vertically aligned slots 26 for receiving mounting screws 28 for fixedly mounting the strike at a vertically adjustable position on the post 12. The strike 10 further includes an intermediate section 30 (best shown in FIGS. 4 and 7) having mounting slots 29 and a strike section 31 having upper and lower bolt-receiving notches 33 and 34. The strike section 31 also has bent over ramp surfaces 36 and 37 which respectively lead to the notches 33 and 34, the upper ramp functioning to lift the bolt 18 and drop it into the associated notch as the gate 16 swings into a closed position as shown in FIG. 7.

Figure 2:
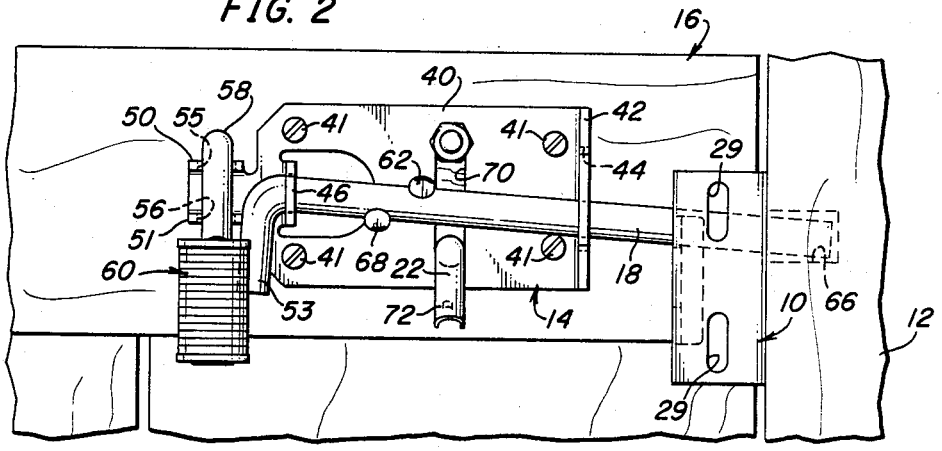
FIG. 2 is a view similar to that of FIG. 1, but showing the bolt in a locked, latch position.
Figure 3:
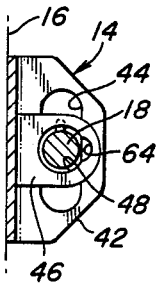
FIG. 3 is a cross-sectional view taken along the line 3—3 of FIG. 1.
Figure 8:
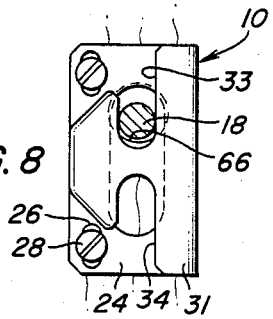
FIG. 8 is a view of the strike taken from along the line 8—8 in FIG. 1.

The latch body 14 is formed from a single metal plate and includes a flat base 40 provided with four holes for receiving mounting screws 41 for securing the latch body 14 to the gate 16. The side of the latch body 14 shown in FIG. 1, for example, may be referred to as the front side, and the side opposite thereof may be termed the rear side. A flange 42, which is provided at the end of the latch body adjacent the strike, extends perpendicularly from the base 40 and includes a vertical slot 44 through which the bolt 18 extends. A second flange 46 is provided with an opening 48 through which the bolt 18 extends. An additional pair of horizontal flanges 50 and 51 are provided at the end of the latch body, and the bolt 18 is adapted to be axially moved between the flanges 50 and 51 to the unlocked position best shown in FIGS. 1 and 4. It may be seen that the bolt 18 has an offturned end 53 which prevents the bolt from being moved into or out of the space between the flanges 50 and 51 unless the offturned end 53 is in a horizontal position. Moreover, the flanges 50 and 51 are provided with aligned openings 55 and 56 for receiving a locking member such as the shackle 58 of a padlock 60 as shown in FIG. 2.

In order to prevent removal of the bolt 18 from the latch body 14 while the latch is mounted to a gate or other large surface, the bolt 18 is provided with an integral lug 62 on the side of the bolt which is diametrically opposite to the offturned portion 53. The opening 48 in the flange 46 is enlarged at 64 at the side away from the base 40 to permit the lug 62 to pass through the enlargement only when the offturned end 53 is in a horizontal position extending toward the base 40. Inasmuch as the end 53 cannot occupy that position while the latch body is mounted to the gate, the bolt 28 cannot be removed.

The base flange 24 of the strike is provided with holes opposite the notches 33 and 34, and a blind hole 66 is provided in the post 12 for receiving the end of the bolt 18 to prevent lifting of the bolt 18 out of the notch 33. If desired, the hole 66 may be vertically elongated to allow for some misalignment due to sagging of the gate and the like. A second lug 68 is longitudinally spaced from the lug 62 and is disposed on the diametrically opposite side of the bolt. Consequently the lug 68 can be moved throught he opening 48 only when the offturned end 53 is in a horizontal position extending away from the base 40. It may thus be seen that the bolt 18 can be moved from the unlocked position shown in FIG. 1 by rotating the offturned end 53 into a horizontal position and then sliding the bolt 18 toward the gate post 12 into the hole 66 therein. The end 53 can then be turned up or down to a vertical position between the flange 46 and one or the other of the horizontal flanges 50, 51 thereby to prevent inadvertent axial movement of the bolt 18 out of the locked position. Of course, with the padlock 60 in place as shown in FIG. 2, the bolt 18 cannot be slidably moved out of the locked position because the shackle 58 blocks movement of the bolt 18 into the space between the flanges 50 and 51.

When the bolt 18 is in an unlocked position wherein it extends between the flanges 50 and 51, it may be lifted up and out of the notch 33 in the trike by means of the thumb lever 22. The thumb lever 22 extends through a vertical slot 70 in the base 40 of the latch body and has a downturned end portion 72. At the other end the lift bar 22 has a flattened thumb plate 74 outside of the handle 20. The plate 74 is larger than the opening 76 through the handle and thus prevents removal of the thumb lever 22 from the other side of the gate. The thumb lever 22 cannot be removed from the handle side of the gate unless the bolt 18 is first removed to permit the thumb lever to be elevated a sufficient distance so that the raised boss 80 of the thumb lever clears the top of the slot 76.

The handle 20 is secured to the gate 16 by nut and bolt asemblies 78 and 79. The upper bolt extends through the top portion of the slot 70 to hold the latch body 14 firmly in place against the gate.

All of the parts of the latch can be packaged in an unassembled condition. When ready for use, the lift bar is first assembled to the handle 20 which is then attached to the gate by the lower bolt assembly 79 with the lift bar extending through the precut slot 77 in the gate. The bolt 18 may then be inserted through the openings 48 and 44 in the flanges 46 and 42 of the latch body and the latch body can then be fastened to the gate to prevent removal of the bolt 18 and the thumb lever 22. The strike can then be secured to the gate post at the proper position.

Figure 4:
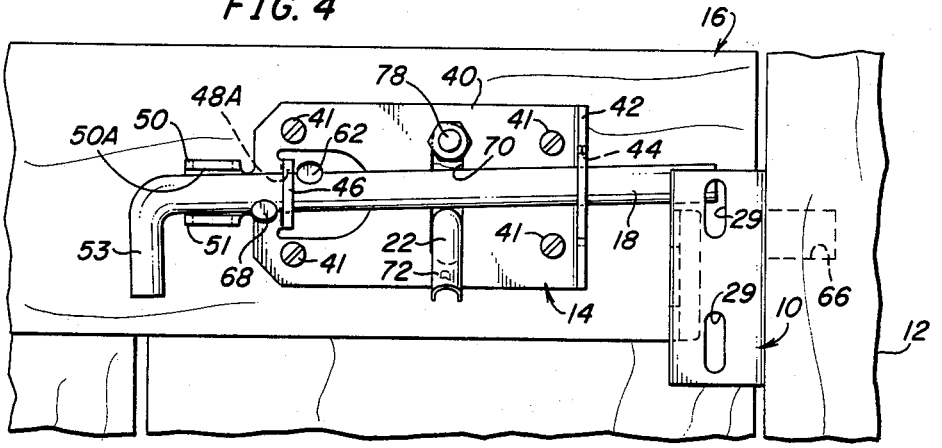
FIG. 4 is a view similar to that of FIG. 1, but showing the bolt in an unlatched position.

In order to lift the bolt 18 out of the notch 33 in the strike, the thumb lever 22 is manually pivoted in a counter-clockwise direction as viewed in FIG. 6 with the bottom edge of the opening 76 being the fulcrum. Initially, the bolt 18 will pivot in a counterclockwise direction as viewed in FIG. 1 about the outer edge 50A of flange 50 and subsequently about the top edge 48A of the opening through the flange 46 as shown in FIG. 4.

The bolt, being assentially cylindrical throughout its operative length, provides greater resistance to beinding than do the conventional flat or rectangular bolts and enables rotation of the bolt between its locked and unlocked positions.

While the present invention has been described in connection with a particular embodiment thereof, it will be understood by those skilled in the art that may changes and modifications may be made without departing from the true spirit and scope of the present invention. Therefore, it is intended by the appended claims to cover all such changes and modifications which come within the true spirit and scope of this invention.

What is claimed:

1. A gate latch for use with a gate, said latch comprising a latch body having a from side and a rear side and further having a generally planar mounting surface adapted to be mounted agains one face of said gate, said mounting surface being disposed on the rear side of said latch body, said latch body having first and second spaced apart flanges respectively extending forwardly from said front side and being provided with openings mutually aligned along an axis lying parallel to said mounting surface, an elongate latch bolt slidably disposed in said openings for axial movement in a direction parallel to said mounting surface between an extended locking position and a retracted position, said latch bolt having an offturned portion at one end thereof, said latch bolt being rotatable in said flanges about said axis, said latch bolt having an enlargement on one side thereof which will pass through said opening in one of said flanges only when said latch bolt is in a predetermined angular postion, and said offturned end being sufficiently long to extend rearwardly of said mounting surface when said bolt is oriented in said predetermined angular position.

2. A gate latch according to claim 1, wherein said mounting plate is provided with a slot, a latch bolt lift member extends through said slot beneath said latch bolt, and said lift member is provided with laterally extending means at one end for preventing said lift member from being removed from said slot while said latch bolt extends through said outwardly extending flanges.

3. A gate latch according to claim 1 wherein said opening in said one of said flanges is non-circular in configuration.

4. A gate latch according to claim 1 wherein said enlargement is disposed between said flanges when said latch is mounted to said gate.

5. In combination, a gate, a gate post disposed adjacent said gate when said gate is in a closed position, a strike mounted to said gate post, a latch body having a front side and a rear side and further having a generally planar mounting surface mounted against one face of said gate, said mounting surface being disposed on the rear side of said latch body, said latch body having first and second spaced apart flanges respectively extending forwardly from said front side and being provided with openings mutually aligned along an axis lying parallel to said mounting surface, an elongate latch bolt slidably disposed in said openings for axial movement in a direction parallel to said mounting surface between an extended locking position in operative engagement with said strike and a retracted position out of engagement which said strike, said latch bolt having an offturned portion at one end thereof, said latch bolt being rotable in said flanges about said axis, said latch bolt having an enlargement on one side thereof which will pass through said opening in one of said flanges only when said latch bolt is in a predetermined angular position, and said offturned end being sufficiently long to abut said face of said gate to prevent said bolt from being oriented into said predetermined position.

6. The combination according to claim 5 wherein said enlargement is disposed between said flanges.

7. In a gate latch, comprising a latch body including a mounting plate having outwardly extending, parallel integral flanges, an elongated opening in one of said flanges, a non-circular opening in the other of said flanges, a latch bolt extending through both of said openings for axial movement in said latch body, said latch bolt having a laterally extending portion disposed between said flanges, said bolt being slidably removable from said latch body in one axial direction through said non-circular opening only when said laterally extending portion is in a predetermined angular position, and said latch bolt having another laterally extending portion which prevents said bolt from being slidably removable from said latch body in the other axial direction through said non-circular opening, said latch body includes a pair of spaced apart horizontal flanges defining therebetween a guideway in alignment with said openings, said latch bolt being slidably disposed in said openings for movement into said guideway, and said horizontal flanges being provided with mutually aligned openings to receive a locking member extending across said guideway to block the entry of said latch bolt into said guideway.

8. a gate latch according to claim 7 wherein said latch bolt is circular in cross-section.

9. A gate latch according to claim 7, wherein said mounting plate is provided with a slot, a latch bolt lift member extends through said slot beneath said latch bolt, and said lift member is provided with laterally extending means at one end for preventing said lift member from being removed from said slot while said latch bolt extends through said outwardly extending flanges.

10. In a gate latch, comprising a latch body including a mounting plate having outwardly extending, parallel integral flanges, an elongated opening in one of said flanges, a non-circular opening in the other of said flanges, a latch bolt extending through both of said openings for axial movement in said latch body, said latch bolt having a laterally extending portion disposed between said flanges, said bolt being sildably removable from said latch body in one axial direction through said non-circular opening only when said laterally extending portion is in a predetermined angular position, and said latch bolt having another laterally extending portion which prevents said bolt from being slidably removable from said latch body in the other axial direction through said non-circular opening, said latch body includes a pair of spaced apart horizontal flanges defining therebetween a guideway in alignment with said openings, said latch bolt being slidably disposed in said openings for movement into said guideway, and said horizontal flanges being provided with mutually aligned openings to receive a locking member extending across said guideway to block the entry of said latch bolt into said guideway.

11. A gate latch according to claim 10, wherein said mounting plate is provided with a slot, a latch bolt lift member extends through said slot beneath said latch bolt, and said lift member is provided with laterally extending means at one end for preventing said lift member from being removed from said slot while said latch bolt extends through said outwardly extending flanges.

* * * * *